United States Patent [19]

Boucherie

[11] Patent Number: 4,733,917

[45] Date of Patent: Mar. 29, 1988

[54] ARRANGEMENT FOR SUPLYING FIBRES TO A FILLING TOOL OF A BRUSH-MAKING MACHINE

[75] Inventor: Lionel Boucherie, Roeselare-Rumbeke

[73] Assignee: Firma G.B. Boucherie, naamloze vennootschap, Izegem, Belgium

[21] Appl. No.: 871,324

[22] Filed: Jun. 6, 1986

[30] Foreign Application Priority Data

Jun. 28, 1985 [BE] Belgium ..... 60732

[51] Int. Cl.[4] ..... A46D 1/08

[52] U.S. Cl. ..... 300/7

[58] Field of Search ..... 221/232, 239; 300/2–11, 21

[56] References Cited

FOREIGN PATENT DOCUMENTS 604274 10/1934 Fed. Rep. of Germany ..... 300/7

868311 5/1961 United Kingdom ..... 300/7

*Primary Examiner*—Mark Rosenbaum

*Attorney, Agent, or Firm*—Schwartz, Jeffery, Schwaab, Mack, Blumenthal & Evans

[57] ABSTRACT

An apparatus for supplying fibers to a filling tool of a brush-making machine is provided. The apparatus includes a slide positioned between a stationary multiple fiber magazine and a bundle remover. The slide has a number of loading spaces for the purpose of moving fibers from the channels of the fiber magazine to the bundle remover. The removal of the fibers from the fiber magazine to the bundle remover is accomplished by first pushing a number of fibers from the magazine into one of the loading spaces on the slide and then moving the filled loading space to a position adjacent the bundle remover. The fibers in the loading space are then pushed into the bundle remover by a separate pusher attachment.

17 Claims, 3 Drawing Figures

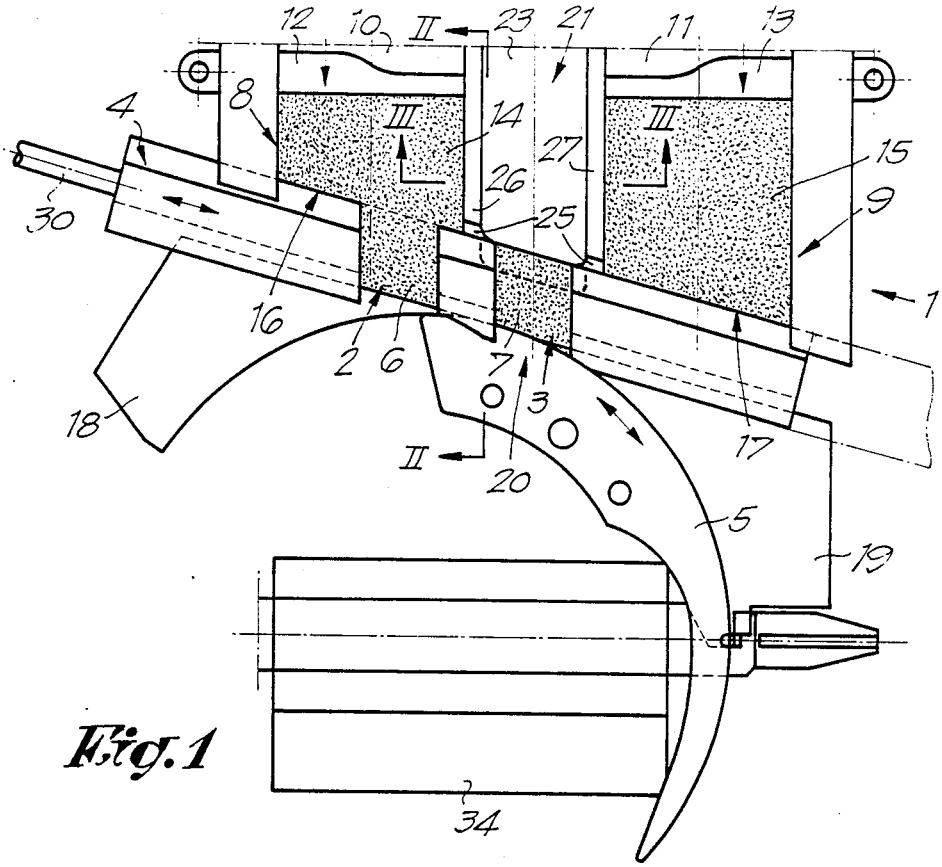
Fig. 1
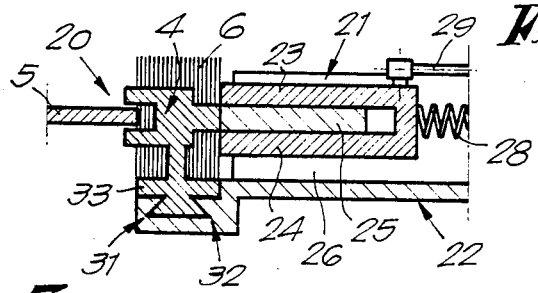
Fig. 2
Fig. 3
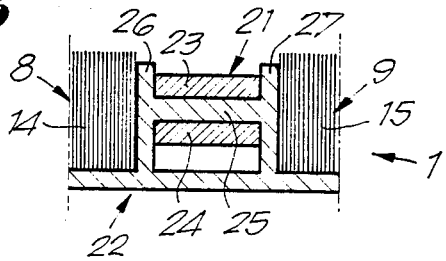

ARRANGEMENT FOR SUPLYING FIBRES TO A FILLING TOOL OF A BRUSH-MAKING MACHINE

The present invention relates to an arrangement for supplying fibres to a filling tool of a brush-making machine and more especially to an arrangement of the type wherein from a multiple fibre magazine or from different fibre channels thereof, different sorts of fibre can be taken by means of a bundle remover in order to suitably feed said fibres into a filling tool.

It is known that for the manufacture of brushes wherein different sorts of fibres with different colours are applied, a plurality of fibre channels is used. In order to present all fibre channels comprising the different fibres to one and the same bundle remover, various arrangements are known.

An arrangement is known wherein the entire fibre magazine is moves so that alternating according to the desired pattern, the suited discharge ends of the fibre channels of this fibre magazine are brought before the bundle remover. Such an arrangement, however, has the disadvantage that a large mass has to be moved so that with high work speeds of the brush-making machine mechanical problems arise as a result of the large mass inertia of the entire fibre magazine. Another disadvantage is that at the one hand, the moving fibre magazine is not suited for being automized and at the other hand, in the case of manual fibre supply, constitutes an inconvenient for the operator.

Other arrangements are known wherein the multiple fibre magazine is substantially stationary but wherein the ends of the fibre channels can be swivelled over some small part. Such arrangements too show the disadvantage that relatively great inertial forces arise. In addition, the construction of such a hinged fibre magazine is rather intricate.

Both aforesaid arrangements also show the disadvantage that because of the desired minimum inertia of the moving parts, such a fibre magazine must not be large resulting therein that the working time of a brush-making machine without the intermediary of an operator remains relatively small.

Another known arrangement provides the supply of fibres to a filling tool from several fibre channels and has been described in an earlier Patent of the Applicant. It consists of a stationary fibre magazine whose discharging ends of the fibre channels comprise means which influence both channels in such a way that only the fibres from the matching channel are allowed up to the bundle remover. Practice has shown that this arrangement is very efficient for relatively low work speeds. However, a serious disadvantage is the rather intricate construction and that it requires an exact adjustment.

So, the present invention relates to an arrangement for the supply of fibres to a filling tool of a brush-making machine that does not show the aforesaid and other disadvantages of the arrangements of the prior art.

By using a relatively small slide which by means of loading spaces brings small fibre packets from the desired fibre channel to the bundle remover, it is achieved according to the present invention that that no large masses have to be moved, which results in the advantage that one can work at high speeds thanks to the low inertial forces. Another advantage connected herewith is that the fibre channels by themselves can be arbitrarily large so that the working time of one machine is very long. Also the use of wide fibre channels is possible now, so that as a result large fibre bundles can be placed herein without the latter having to be flattened beforehand.

The present invention also shows the advantage that the bundle removal obtained is more regular than in a direct removal from the fibre channels. For in fibre channels a certain period of time is required for the hold-down element for suitably pressing together all fibres. However, by using a slide having loading openings of limited size and a special hold-down element co-operating therewith, this disadvantage is avoided.

For this purpose the invention consists of an arrangement for supplying fibres to a filling tool of a brush-making machine, characterized thereby that it consists of a slide which is movably applied between a stationary multiple fibre magazine and a bundle remover, said slide possessing a number of relatively small loading spaces serving as a lock for moving the fibres from the fibre channels of said fibre magazine to the bundle remover.

In order to better show the features of the present invention, a preferred embodiment without any limiting character is described hereinafter by way of an example with reference to the accompanying drawings, wherein:

FIG. 1 represents a top view of an arrangement according to the present invention;

FIG. 2 represents a cross-section according to line II—II in FIG. 1;

FIG. 3 represents a cross-section according to line III—III in FIG. 1.

As represented in FIG. 1, the arrangement for supplying fibres mainly consists in a combination of a multiple fibre magazine 1; a slide 4 provided with loading spaces 2–3; an oscillating bundle remover 5 being operative along said slide 4; means for pushing the fibres 6–7 contained therein from one of said loading spaces 2–3 to the bundle remover 5; and means for driving said slide 4.

According to the embodiment represented, the fibre magazine 1 consists of two fibre channels 8–9 provided at their filling ends 10–11 with hold-down means 12–13 for pressing the fibres 14–15, that are contained in the fibre channels and mostly are of a different kind, towards the discharge ends 16 and 17 respectively of the fibre channels 8 and 9.

Slide 4 is essentially operative in the same plane as fibre magazine 1 and is laterally slidable along the discharge ends 16–17 of the latter. At its other side said slide 4 slides along guides 18–19 bounding a removal opening 20 and serving as fibre separators. Said slide 4 is slidable in such a way that alternating, at the one hand, every loading space 2–3 of it can be brought before a determined fibre channel for filling it and at the other hand, every loading space 2–3 containing the fibres of choice can be placed before the removal opening 20 of bundle remover 5.

The above said means for pressing the fibres 6–7 out of one of the loading spaces 2–3 against the bundle remover 5, are formed, as is represented in FIG. 2, by a pusher attachment 21 that is found in front of removal opening 20. In the embodiment represented this pusher attachment 21 is provided in the dividing wall 22 between both fibre channels 8 and 9 and is U-shaped, the legs 23 and 24 of said U-shape being slidable over a connecting piece 25 whose angles coming in contact with slide 4 are acute in order to secure a clean separation of the fibres. By way of an example the pusher attachment 21 can consist of a spring 28 and optionally a reversing mechanism 29.

The means for driving slide 4 is preferably a cam-lever mechanism or a controlled pneumatic drive of which only the connecting rod 30 is represented in FIG. 1.

Naturally, slide 4 is provided with the necessary longitudinal guides 31–32 for securing a smooth operation. Preferably, the bottom 33 under the loading spaces 2–3 is slidable together with slide 4 and as such is integral herewith.

The bundle remover 5, which in a known way communicates with a filling tool 34, in the embodiment represented is of the half-moon type but it may be of the rectilinear type as well. Conversely it is also possible that both of the bundle remover 5 and the slide 4 are circular.

The operation of the arrangement according to the present invention can be simply deduced from the figures and is as follows. The hold-down means 12 and 13 in the fibre channels 8 and 9 press the fibres 14 and 15 against slide 4. So, the loading space 2 or 3, which at that moment is contiguous to one of the fibre channels 8 or 9 is being filled with the fibres 14 or 15 concerned. In the mean time, bundle remover 5 takes fibres from the loading space 2 or 3 which are in front of hold-down means 21. Hereby, the latter maintains a constant pressure on the fibres 6 or 7 concerned.

Upon passing from one sort of fibres to another, e.g. from fibres 15 to fibres 14, slide 4 of FIG. 1 is shifted to the right so that the left-hand loading space 2 is placed before removal opening 20. Simultaneously the right-hand loading opening 3 comes before the right-hand fibre channel 9 and consequently is filled up with fibres 15.

According to a non-represented variant, the arrangement can also comprise a fibre magazine possessing more than two fibre channels. Naturally, in that case a separate closing element, formed, e.g., by an intermediate slide, is provided between the fibre magazine and the slide in order to fill the right loading opening with the right sort of fibres.

The present invention is by no means limited to the embodiment represented in the accompanying drawings and described by way of an example, but such an arrangement for the supply of fibres to a filling tool of a brush-making machine can be realized in any form and dimensions without exceeding the scope of the present invention.

I claim:

1. An apparatus for loading a supply of fiber into the removal opening of a bundle remover of a filling tool of a brush making machine, comprising:

a fiber magazine having a plurality of fiber channels for holding several units of fiber and having a discharge end;

means for removing one unit of fiber from the fiber magazine comprising a slide reciprocably movable between the discharge end of the fiber magazine and the removal opening of the bundle remover and having a plurality of loading spaces, each loading space being adapted to receive the unit of fiber; and means for inserting each removed unit of fiber into the removal opening of the bundle remover at a substantially uniform pressure, the inserting means comprising a pusher attachment selectively reciprocally movable in the direction of the removal opening of the bundle remover and positioned relative to the removal opening of the bundle remover such that a loading space of the slide is movable between the pusher attachment and the removal opening of the bundle remover, whereby, when a loading space having fibers therein is moved between the pusher attachment and the removal opening, the pusher attachment is moved toward the removal opening to push the fibers in the loading space into the bundle remover.

2. Arrangement according to claim 1, wherein the number of loading spaces of said slide equals the number of fibre channels provided in said fibre magazine.

3. Arrangement according to claim 1, wherein said slide is rectilinear.

4. Arrangement according to claim 1, said slide is circular.

5. Arrangement according to claim 1, wherein said bundle remover is rectilinear.

6. Arrangement according to claim 1, wherein said bundle remover is circular.

7. Arrangement according to claim 1, wherein said slide is bounded at one side by a plurality of guides that bound said removal opening along which said bundle remover is movable and function as fibre separators.

8. Arrangement according to claim 1, wherein that said slide is actuated by a pneumatic driving mechanism which via a connecting rod is connected to said slide.

9. Arrangement according to claim 1, wherein said slide is actuated by a cam-lever mechanism.

10. Arrangement according to claim 1, wherein said pusher attachment is built into a dividing wall between two fibre channels.

11. Arrangement according to claim 10, wherein said pusher attachment is pusher attachment, the legs of the U-shape being slidable over a connecting piece forming a connection between two side-walls of said dividing wall.

12. Arrangement according to claim 11, wherein said connecting piece acts as a fibre separator.

13. Arrangement according to claim 1, wherein said pusher attachment is provided with a reversing mechanism.

14. Arrangement according to claim 1, wherein said slide is provided with a bottom.

15. Arrangement according to claim 1, wherein said slide is guided by longitudinal guides.

16. Arrangement according to claim 1, wherein said fibre magazine (1) comprises more than two fibre channels and various fibre separator means are provided for selectively bringing and keeping the fibres outside the range of said slide.

17. Arrangement according to claim 16, wherein said bring and keeping means comprises a second slide movable between said first slide and the discharge ends of the various channels.

* * * * *